US005611485A

United States Patent [19]

Davis

[11] Patent Number: 5,611,485

[45] Date of Patent: Mar. 18, 1997

[54] METHOD AND APPARATUS FOR DISPENSING A SUBSTANCE

[75] Inventor: Robert G. Davis, Atascadero, Calif.

[73] Assignee: William W. Gibbs, Atascadero, Calif.; a part interest

[21] Appl. No.: 289,376

[22] Filed: Aug. 12, 1994

[51] Int. Cl.[6] ..... B05B 7/28

[52] U.S. Cl. ..... 239/8; 239/270; 239/364; 239/373

[58] Field of Search ..... 239/364, 365, 239/366, 369, 270, 373, 351, 8

[56] References Cited

U.S. PATENT DOCUMENTS

| | | | |
|---|---|---|---|
| 1,104,217 | 7/1914 | Paasche . | |
| 1,196,691 | 8/1916 | Hopkins | 239/365 X |
| 1,622,224 | 3/1927 | Gale | 239/365 |
| 1,727,500 | 9/1929 | Beach | 239/364 |
| 1,765,398 | 6/1930 | Birkenmaier | 239/364 |
| 2,882,894 | 4/1959 | Fahey et al. . | |
| 3,831,851 | 8/1974 | Gsell et al. | 239/373 X |
| 4,174,071 | 11/1979 | Lau et al. . | |
| 4,989,787 | 2/1991 | Nikkel et al. . | |
| 5,054,687 | 10/1991 | Burns et al. . | |
| 5,074,467 | 12/1991 | Geberth . | |
| 5,100,060 | 3/1992 | Haferkorn . | |
| 5,119,992 | 6/1992 | Grime . | |
| 5,236,128 | 8/1993 | Morita et al. | 239/365 |

FOREIGN PATENT DOCUMENTS

| | | | |
|---|---|---|---|
| 466452 | 7/1950 | Canada | 239/270 |
| 714406 | 7/1965 | Canada | 239/366 |
| 853389 | 3/1940 | France | 239/270 |
| 1037477 | 9/1953 | France | 239/270 |
| 548727 | 4/1932 | Germany | 239/365 |

OTHER PUBLICATIONS

Binks Manufacturing Co., Chicago, Illinois, Catalog No. 956A, "Binks Everything For Spray Painting" Catalog pp. 21, 25, 38, 39 and 44.

Busch, Inc.; pp. 1–10 R5 Series Vacuum Pumps and Systems.

Gast Manufacturing Corporation; pp. 1–16 Air Info.

Gast Manufacturing Corporation; pp. 1–4 Oil Less Vacuum Pumps and Compressors.

*Primary Examiner*—Andres Kashnikow

*Attorney, Agent, or Firm*—Worrel & Worrel

[57] ABSTRACT

A method for dispensing a substance including the steps of housing the substance in a container in a substantially flowable state; establishing a path in proximity to the substance for movement of the substance from the container; and applying pressure to the substance within the container to force the substance from the container and along the path. An apparatus for dispensing a flowable substance including a container having an interior adapted to receive the flowable substance; an assembly adapted operably to be connected to the container and having a first passage through which the flowable substance is to be dispensed and communicating with the interior of the container through an opening; an assembly defining a second passage communicating with the interior of the container; and a mechanism for individually pressurizing the first and second passages to cause the flowable substance to be forced from the interior of the container through the opening and into the first passage to be dispensed.

5 Claims, 4 Drawing Sheets

METHOD AND APPARATUS FOR DISPENSING A SUBSTANCE

BACKGROUND OF THE INVENTION

1. Field of the Invention

The present invention relates to a method and apparatus for dispensing a substance and, more particularly, to such a method and apparatus which are particularly well suited to the application of flowable substances as paint, lacquer, stain, and other surface treating substances.

2. Description of the Prior Art

A variety of environments exist in which the application of flowable substances is plagued by a multiplicity of problems. The problems result from such general considerations as the characteristics of the flowable substance, the surface to which the flowable substance is to be applied, the aesthetic effect desired to be achieved by the application of the flowable substance and the environment within which the application process takes place. For example, in the application of flowable substances such as paint, lacquer and the like to surfaces, these problems are particularly acute. To use a specific example for purposes of illustration, in the painting of automotive vehicles, all of these considerations interplay in such a manner as not only to require painstaking control over all aspects of the application process and long years of training to achieve an adequate result, but also render impossible the achievement of what would otherwise be the precise result desired.

Where, for example, a portion of an automotive vehicle is to be repainted, it is of course desired that the repainted surface match the existing paint. However, the conditions to which reference has previously been made cause a precise match to be unattainable. The specific reasons for this are many. The existing paint typically has deteriorated to some degree so that the original paint which was employed would not match the existing paint. Furthermore, since vehicles are typically painted at the time of manufacture by a method, such as dipping the vehicle in a paint bath, which is impractical for repainting, the differences in the methods of application inherently produce different results.

In addition to these general limitations, there are a plethora of other chronic problems with conventional methods and equipment. Conventionally, the paint is atomized during application so that by volume, in effect, a minimum amount of paint is mixed with a maximum amount of air and sprayed in the direction of the surface to be repainted. Such atomization presents a host of difficulties which are difficult, or impossible, for even the most experienced operator to control. In a given volume of the atomized paint, the paint particles are not evenly distributed so that, upon contact with the surface to be repainted, the paint is, at best, unevenly applied.

Second, because for a given volume a minimum amount of paint is present in the atomized paint, the paint is applied in very thin layers requiring numerous passes and, perhaps, more than one coat to achieve an adequate result. The process of repeatedly passing the atomized paint over the surface to be repainted inherently causes uneven application of the paint. This produces visible imperfections such as patterns, lines, thin areas, runs and the like.

Third, the atomized paint is subject to the vagaries of air currents, heat, moisture and the like causing the paint to be applied in a manner beyond the control of even the most experienced operator.

Fourth, the atomized paint is highly susceptible to contamination by the spray equipment as well as from the environment. Such contaminants as dust, grease, oil, moisture, insects and a multiplicity of other contaminants are readily attracted to and entrapped by the atomized paint resulting in a further diminishment of the result.

Fifth, the composition of the paint is difficult to control when it is atomized due to the random intermixture of the paint and air particles. This problem is particularly acute where the paint to be applied has been produced to create a particular aesthetic effect. For example, where the paint to be applied is to have a highly metallic appearance, the mica or other metallic materials within the paint are difficult, or impossible, to control where the paint is atomized. The result in the repainted surface may be such that the metallic particles are buried in the paint producing a non metallic, or flat, appearance in contrast with the existing paint.

Still further, these other chronic problems virtually ensure that the same paint cannot be applied to produce the same result by different operators, or in different environments, or even by the same operator continuously within the area being repainted.

Therefore, it has long been known that it would be desirable to have a method and apparatus for dispensing a substance which are operable to ensure that the substance can be dispensed in precisely the manner desired to achieve precisely the result desired; which are not subject to influences which cause a variation in the result achieved; which are particularly well suited to the application of such substances as paints, lacquers, and other surface treatment materials; which permit different operators in different environments to achieve the same result, thus being able to replicate the result under virtually all conditions; which permit the repainting of surfaces to achieve the same appearance as the existing paint; and which are otherwise entirely effective in achieving their operational objectives.

SUMMARY OF THE INVENTION

Therefore, it is an object of the present invention to provide an improved method and apparatus for dispensing a substance.

Another object is to provide such a method and apparatus which permit a wide variety of substances to be dispensed in such a manner as to avoid substantially all of the problems associated with conventional methods and apparatus directed to the same purpose.

Another object is to provide such a method and apparatus which permit a flowable substance to be dispensed in a substantially more uniform mass than has heretofore been possible and avoiding the problems associated with atomization of the substances experienced with conventional methods and apparatus.

Another object is to provide such a method and apparatus which are particularly well suited to the application of such substances as paint, lacquer, and the like and particularly where employed in the painting, or repainting, of surfaces affording the ability substantially more effectively to match the precise aesthetic effect desired.

Another object is to provide such a method and apparatus which are unusually well suited to the application of paint in the repainting of metal surfaces, such as of automotive vehicles, permitting the operator to apply the paint so as more closely to achieve the precise appearance desired than has heretofore been possible.

Another object is to provide such a method and apparatus which permit different operators in different environments to apply paint and other surface treatment substances producing the same results.

Another object is to provide such a method and apparatus which permit paint to be applied dependably to produce the result desired without the years of experience conventionally required to produce an adequate result.

Another object is to provide such a method and apparatus which permit the application of paint with significantly less risk of contamination from contaminants in the apparatus itself, or in the environment, than has heretofore been possible.

Another object is to provide such a method and apparatus which are particularly well suited to the application of paint wherein the result to be achieved requires that the composition of the paint carefully be controlled to achieve the desired result such as in the application of metallic paint.

A still further object is to provide such a method and apparatus which permit paint and the like to be applied evenly in such a manner that substantially no imperfections resulting from the application process itself, such as patterns, bubbles, lines, runs, thin areas or the like are present.

Further objects and advantages are to provide improved elements and arrangements thereof in an apparatus for the purpose described which is dependable, economical, durable and fully effective in accomplishing its intended purpose.

DESCRIPTION OF THE PREFERRED EMBODIMENT

Figure 1:
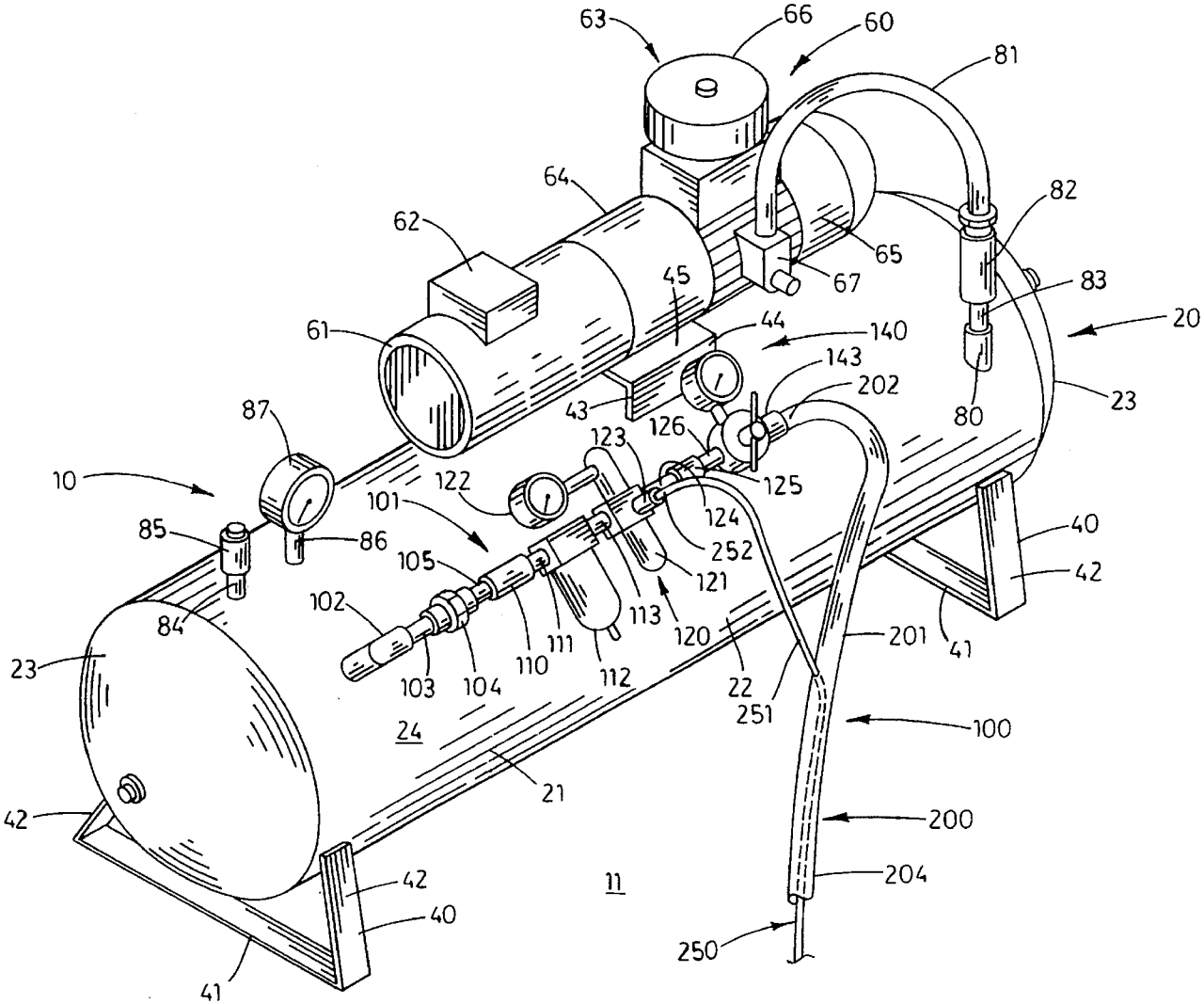
FIG. 1 is a fragmentary perspective view of a pressure system of the apparatus for dispensing a substance of the present invention employed in the practice of the method hereof.

Referring more particularly to the drawings, the apparatus for dispensing a substance of the present invention is generally indicated by the numeral 10 in FIG. 1. While the method and apparatus of the present invention can be employed in a wide variety of different embodiments and environments, they have particular utility in the application of such flowable substances as paint, lacquer and other surface treatment substances. The illustrative embodiment hereof is employed in the application of paint, such as in the repainting of automotive vehicles. However, the method and apparatus are useful in the application of a wide variety of flowable substances for virtually any purpose.

In the illustrative environment, the portion of the apparatus 10 shown in FIG. 1 is rested on a surface of support 11 which may be visualized as a concrete floor. The apparatus includes a pressure system generally indicated by the numeral 20. The pressure system is, in this case, a pressure system adapted to produce and store compressed air at a selected air pressure. The pressure system has a tank or reservoir 21 which, in the illustrative embodiment, is constructed of stainless steel. The reservoir has a stainless steel cylindrical side wall 22 and opposite dome shaped, stainless steel end walls 23. The side wall and end walls have outer surfaces 24 and opposite inner surfaces 25. The inner surfaces bound an interior chamber 26 which is, in the illustrative embodiment, is of a 20 gallon capacity.

A pair of leg assemblies 40 are mounted on the outer surface 24 of the cylindrical side wall 22 of the reservoir 21 individually adjacent to the end walls 23, as shown in FIG. 1. Each of the leg assemblies has a base plate 41 which, together with the other base plate define a flat plane adapted to rest in stable relation on the surface of support 11. Each base plate 41 is mounted on the outer surface of the cylindrical side wall of the reservoir by a pair of upwardly convergent leg members 42. A compressor mounting assembly 43 is mounted on the outer surface 24 of the cylindrical side wall 22 of the reservoir. The compressor mounting assembly has a pair of leg members 44 interconnected by a flat mounting plate 45.

A compressor assembly 60, in the illustrative embodiment an air compressor assembly, is mounted on the compressor mounting assembly 43 substantially in longitudinal alignment with the reservoir 21. In the preferred embodiment, the compressor assembly is an oiless two horse power, Gast rotary vane pump and compressor. However, any suitable pump compressor can be employed. The compressor assembly includes a motor 61 mounting a pressure relief valve 62 contained within the housing on the motor shown in FIG. 1. The motor is mounted in driving relation to a separate drive rotary vane air compressor 63 having a rotary vane section 64 and a compressor section 65. The motor, rotary vane section and compressor section are mounted in axial alignment, as shown in FIG. 1. The compressor section has an air intake and filter assembly 66 and a conduit connection assembly 67.

A tubing or conduit fitting 80 is mounted on the cylindrical side wall 22 of the reservoir 21 communicating with the interior chamber 26 of the reservoir. A first section of tubing or conduit 81 is mounted on the conduit connection assembly 67 of the compressor section 65 in compressed air receiving relation thereto. A one way check valve 82 is mounted on the first section of conduit remote from the conduit connection assembly and, in turn, mounts a second section of tubing or conduit 83 connected in compressed air supplying relation to the interior chamber 26 of the reservoir through the conduit fitting 80. The check valve 82 is operable to permit movement of compressed air from the compressor section into the interior chamber of the reservoir and to prevent movement of compressed air in the opposite direction. A pressure relief valve fitting 84 is mounted on the cylindrical side wall 22 extending therethrough into communication with the interior chamber 26. A pressure relief valve 85 is mounted on the distal end of the pressure relief valve fitting. A pressure gauge fitting 86 is mounted on the cylindrical side wall of the reservoir also extends into communication with the interior chamber of the reservoir. A pressure gauge 87 is mounted on the distal end of the pressure gauge fitting 86. The pressure relief valve is operable to release air pressure from the interior chamber of the reservoir when the air pressure therewithin rises to a predetermined upper limit. The pressure gauge 87 operates continuously to register the air pressure within the interior chamber of the reservoir.

The apparatus 10 has a pressure control system generally indicated by the numeral 100 in FIG. 1. The pressure control system has a pressure manifold assembly 101 which includes a tank fitting 102 mounted on the cylindrical side wall 22 of the reservoir and extending therethrough into communication with the interior chamber 26 of the reservoir 21. A conduit 103 is mounted on the fitting 102 in fluid receiving relation and, in turn, mounts a coupling 104 thereon. A conduit 105 is mounted on the coupling 104 in fluid receiving relation. A one way check valve 110 is mounted on the conduit 105 and, in turn, mounts a conduit 111 thereon. A water trap assembly 112 is mounted on the conduit 111 and, in turn, mounts a conduit 113 thereon. Thus, the pressure manifold assembly 101 establishes a path for movement of pressurized air from the interior chamber 26 of the reservoir through the fitting 102, conduit 103, coupling 104, conduit 105, one way check valve 110, conduit 111, water trap assembly 112, and conduit 113. The one way check valve 110 is operable to permit movement from the interior chamber of the reservoir through the pressure manifold assembly as described from left to right as viewed in FIG. 1, but not from right to left. Water trap assembly is operable to remove moisture from the compressed air.

A regulator assembly 120 is mounted on the conduit 113 in fluid receiving relation. The regulator assembly includes a regulator 121 mounting a pressure gauge 122. The regulator assembly mounts a secondary hose connection and one way check valve 123 in fluid receiving relation. The conduit 124 is mounted on the regulator assembly 120, also in fluid receiving relation. A one way check valve 125 is mounted on the conduit 124 in fluid receiving relation and, in turn, mounts a conduit 126 thereon in fluid receiving relation. The one way check valve operates to permit movement of compressed air therethrough from left to right, as viewed in FIG. 1, but not from right to left.

A regulator assembly 140 is mounted on the conduit 126 in fluid receiving relation. The regulator assembly includes a regulator 141 mounting a pressure gauge 142. The regulator assembly has a primary hose connection 143 mounted thereon in fluid receiving relation.

Figure 2:
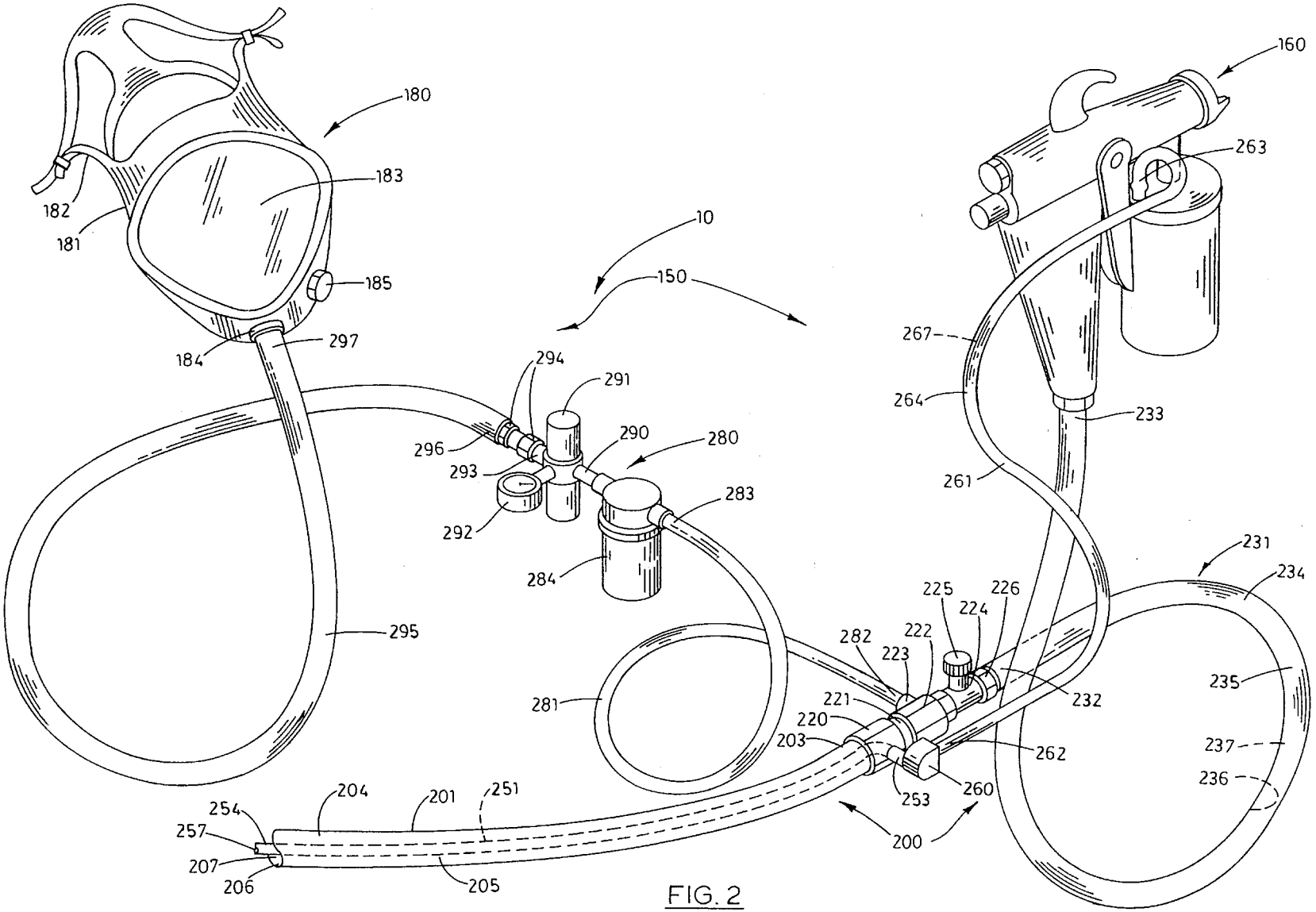
FIG. 2 is a somewhat enlarged, fragmentary perspective view of the air application system of the apparatus of the present invention employed in the practice of the method hereof.
Figure 3:
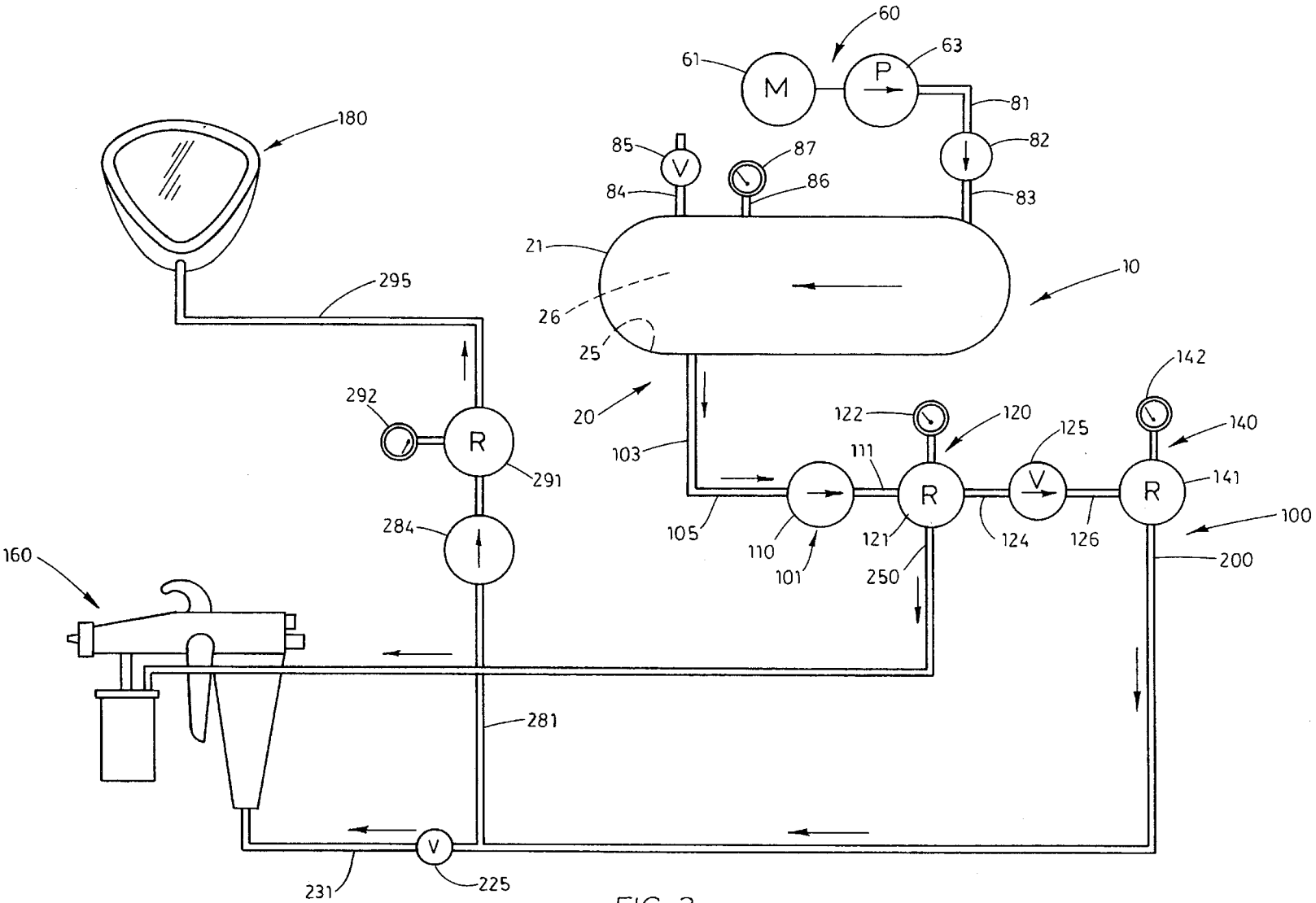
FIG. 3 is a schematic diagram of the apparatus of the present invention.
Figure 4:
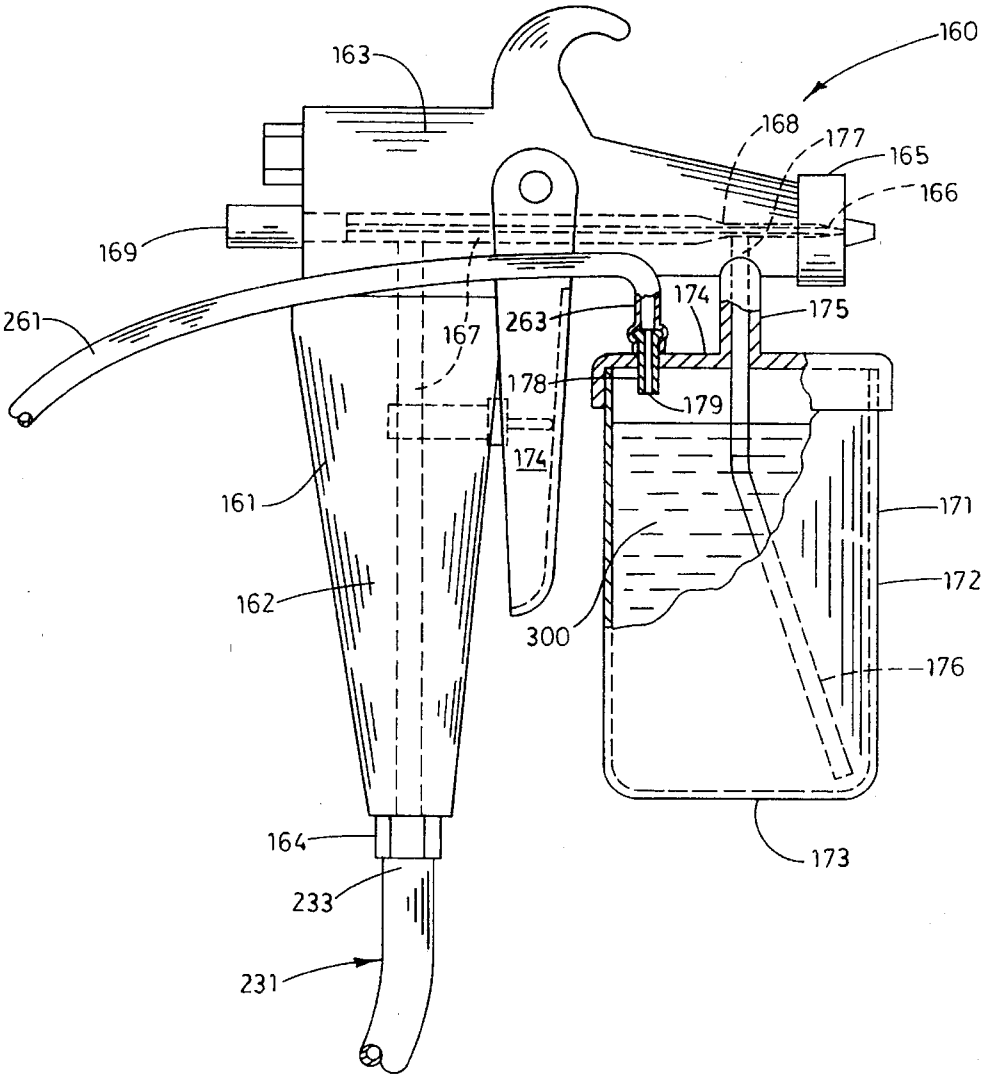
FIG. 4 is a somewhat enlarged, fragmentary, side elevation of the paint gun assembly of the apparatus of the present invention.

The apparatus 10 has an air application system generally indicated by the numeral 150 in FIG. 2. The air application system includes a paint gun assembly 160 which is shown in somewhat greater detail in FIG. 4. The paint gun assembly has a gun body 161 having a handle portion 162 and a right-angularly related, barrel portion 163. A hose coupling 164 is mounted on the lower end of the handle portion, as viewed in FIG. 4. A nozzle 165, having needle valve seat or orifice 166, is mounted on the front of the barrel portion 163. A first passage 167 interconnects the hose coupling 164 and the orifice 166 of the nozzle 165. The first passage has a venturi tube 168 therein adjacent to the orifice 166. A needle valve assembly 169 extends longitudinally of the portion of the first passage extending through the barrel portion of the gun body and is adjustable to control the volume of discharge through the orifice in the conventional manner. A trigger assembly 170 is operably mounted on the gun body 161 for movement in controlling relation to an on/off control vane, shown adjacent to the trigger assembly in FIG. 4, which can be closed or opened by means of the trigger assembly to correspondingly close or open the first passage therethrough. The trigger assembly is shown in FIG. 4 in the normally closed position for the valve. The trigger assembly is movable in a clockwise direction, as viewed in FIG. 4, to open the valve. The trigger assembly is linked to the needle valve assembly so that when the trigger assembly is moved to the opened position, the needle valve assembly is also pulled a predetermined adjusted distance from the orifice. This establishes fluid communication between the hose coupling 164, along the first passage 167, through the venturi tube 168 and from the gun body through the orifice 166 of the nozzle 165.

A paint container 171, preferably constructed of stainless steel, and having a cylindrical side wall 172 and a bottom wall 173 is adapted removably to be mounted on a lid 174 by means of suitable screw threads, not shown, on the interior peripheral surface of the lid and the outer, upper periphery of the cylindrical side wall of the paint container. A seal, also not shown, is provided so that when the lid and container are screw-threadably engaged in a fully tightened relationship, the interior of the paint container, or the area defined within the container and lid, is pressurizable except as hereinafter noted. The lid 174 is mounted on the barrel portion 163 of the gun body by a mounting tube 175 which is itself mounted on the gun body just rearwardly of the nozzle 165. A siphon tube 176 communicates with the mounting tube and extends downwardly from the lid within the interior of the paint container and to a terminal end adjacent to the bottom wall 173 of the container. The mounting tube and thereby the siphon tube, communicate with the venturi tube of the first passage through an opening 177 in the barrel portion of the gun body. A pressure tube 178 is mounted on and extends through the lid 174 in spaced relation to the siphon tube and defines a second passage 179 extending therethrough and interconnecting the interior of the paint container and the exterior of the container. The pressure tube preferably has a rib, or annulus, about the outer end portion thereof, as shown in FIG. 4, for purposes subsequently to be described.

The air application system 150 further includes an air mask assembly 180 adapted to be used by the operator of the paint gun assembly 160, as will hereinafter be described in greater detail. The air mask assembly has a resilient plastic housing 181 having a head strap assembly 182. A glass viewing plate 183 is mounted on the resilient housing. Thus, the air mask assembly is adapted to be fitted on the head of an operator and secured in position using the head strap assembly 182 with the glass viewing plate 183 extending across the face of the operator. An air hose connection 184 is mounted in the resilient housing 181 beneath the glass viewing plate 183. An air vent, or exhaust, 185 is mounted in the resilient housing so as to establish a path for air movement from the air mask assembly during usage.

The apparatus 10 has a primary hose assembly, or first conduit, generally indicated by the numeral 200. The first conduit has a first section 201 having a proximal end portion 202 visible in FIG. 1 and an opposite, distal end portion 203 visible in FIG. 2. The first section has a cylindrical wall 204 which is preferably constructed of durable, reinforced resilient tubing material. The wall has a cylindrical outer surface 205 and an opposite cylindrical inner surface 206 defining a cylindrical internal passage 207.

A conduit coupling 220 is mounted on the distal end portion 203 of the first section 201 of the first conduit 200. As shown in FIG. 2, a nipple 221 is mounted in the coupling 220 and, in turn, mounts a coupling 222. The coupling 222 has a conduit or hose connection 223. A conduit 224 is mounted on the coupling 222 and mounts an adjustment valve 225 therein. A coupling 226 is mounted on the conduit 224.

The first section 201 of the first conduit 200 mounts a second section 231 of the first conduit. The second section has a proximal end portion 232 which is mounted on the coupling 226 in fluid receiving relation and an opposite distal end portion 233 which is mounted on the coupling 164. The second section of the first conduit also has a cylindrical wall 234 constructed of a resilient, durable material having a cylindrical outer surface 235 and a cylindrical inner surface 236. The inner surface 236 bounds a passage 237. Thus, a path of movement for air under pressure is established from the interior chamber 26 of the reservoir 21, through the manifold assembly 101, along the first conduit 200 and to the first passage 167 of the paint gun assembly 160 through the coupling 164.

The air application system 150 has a secondary hose assembly or second conduit generally indicated by the numeral 250. The second conduit has a first section 251 including a proximal end portion 252 mounted in fluid communication with the secondary hose connection on one way check valve 123 of regulator assembly 120 and an opposite distal end portion 253 visible in FIG. 2. The first section of the second conduit has a cylindrical wall which is of smaller diameter than the diameter of the passages 207 of the first section 201 of the first conduit 200. As shown in FIGS. 1 and 2, the first section 251 of the second conduit 250 is extended into the passage 207 of the first section 201 of the first conduit through a suitable opening in the wall 204 and extends along the passage 207 thereof in substantially axial alignment therewith. The distal end portion 253 of the first section 251 of the second conduit 250 extends from the first section of the first conduit through a suitable opening in the coupling 220, as shown in FIG. 2. Suitable seals, not shown, are provided at the points of entry and exit of the first section 251 of the second conduit into and from the first section 201 of the first conduit 200. In this manner, the first section 201 of the first conduit 200 operates to protect the first section 251 of the second conduit 250 from wear or damage caused by contact with the concrete floor 11, or by exposure to foot traffic or sharp objects. Nonetheless, the passage 207 of the first section of the first conduit is of sufficient diameter fully to permit compressed air to pass therealong about the first section of the second conduit.

The first section 251 of the second conduit 250 has a passage 257 extending the entire length thereof through the proximal end portion 252 and through the distal end portion 253 thereof.

A coupling 260 is mounted on the distal end portion 253 of the first section 251 of the second conduit 250 externally of the first conduit 200. The second conduit 250 has a second section 261, having a proximal end portion 262 connected in fluid receiving relation to the coupling 260 and an opposite distal end portion 263 which is fitted over the exterior end of the pressure tube 178 of the lid 174 in fluid transferring relation to the second passage 179 thereof, as shown in FIG. 4.

The second section 261 has a cylindrical wall 264 identical to the wall 254 of the first section 251 and having a passage 267 extending the full length thereof. Thus, a path for fluid movement of compressed air is established from the interior chamber 26 of the reservoir 21, through the pressure manifold assembly 101, along the second conduit 250 and into the interior of the paint container 171.

The air application system 150 further includes a mask air supply assembly, or a third conduit, generally indicated by the numeral 280 in FIG. 2. The third conduit has a first section 281 having a proximal end portion 282 mounted on the hose connection 223 of the coupling 222 in fluid receiving relation to the first conduit 200. The first section has a distal end portion 283 on which is mounted an air filter assembly 284.

A fitting 290 is mounted on the air filter assembly 284 in fluid receiving relation and, in turn, mounts a pressure regulator 291 thereon. The pressure regulator 291 mounts a pressure gauge 292 and a conduit 293. A coupling assembly 294 is mounted on the conduit 293 and, in turn, mounts a second section 295 of the third conduit 280 in fluid receiving relation. The second section has a proximal end portion 296 mounted on the coupling assembly 294 and an opposite distal end portion 297 mounted on the air hose connection 184 of the air mask assembly 180. Thus, a path of fluid movement for air under pressure is established from the interior chamber 26 of the reservoir 21, through the pressure manifold assembly 101, the first section 201 of the first conduit 200, through the coupling 222, along the first section 281 of the third conduit 280, through the air filter assembly 284 and pressure regulator 291, through the second section 295 of the third conduit 280 and into the interior of the air mask assembly 180.

As shown in FIG. 4, paint is housed in the container 171 and is generally indicated by the numeral 300.

OPERATION

The operation of the described embodiment of the apparatus of the subject invention and the practice of the method hereof are hereinafter described.

As previously noted, the method and apparatus of the present invention are adapted for usage in a wide variety of embodiments and, similarly, in a wide variety of operative environments. However, they are particularly well suited to the application of flowable substances such as paint, lacquer, and the like. In the illustrative embodiment, as previously noted, the method and apparatus are described as employed in the application of paint, such as in the repainting of a portion of an automotive vehicle where the paint to be applied is intended to match as closely as possible the existing paint on the automotive vehicle.

Using suitable controls, not shown, the motor 61 of the compressor assembly 60 is operated to drive the rotary vane air compressor 63 to establish the desired air pressure within the interior chamber 26 of the reservoir 21. Thus, ambient air is drawn in through the air intake and filter assembly 66, compressed by the compressor assembly 60 and delivered to the interior chamber of the reservoir through the first and second sections of conduit 81 and 82 with the one way check valve 82 operating to ensure that the compressed air only moves therethrough into and not from the interior chamber 26. The air pressure selected to be maintained in the reservoir by the compressor assembly can be set for the pressure most appropriate to the flowable substance to be applied. In the illustrative embodiment where paint is to be applied in the repainting of an automotive vehicle, the air compressor is set to maintain a pressure within the interior chamber 26 of substantially about 15 to 18 pounds per square inch and operates, as necessary, to maintain this pressure.

During the establishment of the air pressure within the interior chamber 26 of the reservoir 21, the regulator 121, and preferably the regulators 141 and 291, are closed so that there is no movement of compressed air beyond the regulator 121.

In the mean time, the surface to which the paint is to be applied is prepared in the accordance with conventional practice. The paint 300, or other flowable substance to be applied in accordance with the method and apparatus of the present invention, is deposited within the interior of the container 171. The container is filled to the level desired and then screw-threadably secured on the lid 174 in fluid sealing relation as previously described. This establishes a fluid and air tight environment except for the second passage 179 which communicates with the interior of the container just beneath the lid and with the exception of the siphon tube 176 which leads from the entry point adjacent the bottom wall 173 of the container and extends into communication with the first passage 167 of the paint gun assembly 160 through the opening 177.

With the trigger assembly 170 of the paint gun assembly 160 in the normally closed position, the first passage 167 is closed by the valve within the handle portion 162 of the gun body 161 as previously described and the needle valve assembly 169 seals the orifice 166. The regulators 121, 141 and 291 are then adjusted to the settings desired for the particular paint to be applied. The preferred settings can vary substantially depending upon the particular paint to be applied and the aesthetic effect desired. For example, however, with the pressure maintained in the reservoir 21 at 15 to 18 pounds per square inch, the regulator 121 may be adjusted so that the operating pressure within paint container 171 is 9 to 10 pounds per square inch. The regulator 141 may be set so that the operating pressure at the orifice 166 is 5 to 10 pounds per square inch. These pressures are substantially less than the normal operating pressures of conventional paint gun systems.

When the operator is ready to use the paint gun assembly 160 in the application of the paint to a work surface, he places the air mask assembly 180 over his head tightening the head strap assembly 182 and positioning the viewing plate 183 for usage thereof. The pressure regulator 291 is adjusted to supply the desired amount of compressed air to the interior of the air mask assembly.

With the trigger assembly 170 of the paint gun assembly 160 in the normally closed position, the operator can more precisely adjust the pressure regulators 121 and 141 to the desired settings. The normally closed trigger assembly operates as described to prevent operation of the paint gun assembly. However, if desired, the distal end portion 263 can be removed from the pressure tube 178 so that the container 171 does not remain pressurized until ready. The adjustment valve 225 can similarly be adjusted closed to seal the internal passage of the first conduit 200 from the first section 201 to the second section 23 1 thereby avoiding strain on the paint gun assembly if desired.

When the operator is ready to apply the paint 300, the distal end portion 263 is fitted about the pressure tube 178 and the adjustment valve 225 opened to the desired setting. When the operator operates the trigger assembly 170 to move it from the normally closed position to the open position, the orifice 166 is opened by the needle valve assembly 169 and the first passage 167 is opened through the valve in the handle portion 162 of the gun body. Passage of compressed air through the venturi tube 168 applies a negative pressure through the opening 177 to the siphon tube 176. The pressurization of the paint within the container 171 forces the paint into and up the siphon tube into the first passage through the opening 177. Since the pressure of the compressed air moving along the first passage of the paint gun assembly is considerably less than that in conventional paint gun systems and with the application of compressed air to the paint within the container, the paint moves in a substantially contiguous mass along the first passage and through the orifice 166 of the nozzle 165 with minimal atomization. Stated in different terms, the paint passing from the orifice of the nozzle is a substantially unitary mass dissimilar to that in all conventional spray painting systems. The stream of paint discharged from the nozzle is thus much more equivalent to paint applied by processes such as dipping, which are performed at the time of manufacture, than in any conventional spray painting systems. Thus, for a given volume of the stream leaving the nozzle, the ratio of paint to air is significantly greater than is the case with conventional spray painting systems.

Operating the paint gun assembly 160 and apparatus 10 as described, the operator applies the paint to the surface to be painted using otherwise conventional techniques. However, because the ratio to paint to air in the stream is significantly greater than with conventional devices, the paint is applied much more quickly and evenly than with conventional spray painting methods and devices. Since the paint is not atomized to any degree approaching that of conventional systems, the stream of paint is significantly less susceptible to movement by air currents and therefore is applied to the target surface precisely as directed by the operator. Furthermore, the velocity of the fluid stream from the nozzle is significantly less than with conventional systems thereby reducing imperfections resulting from splattering of the paint against the target surface. In addition, since more paint is applied for a given period of operation, the operator need not apply the paint over the same area repeatedly to achieve the thickness desired. This translates, in addition, into the avoidance of imperfections such as variation in the thickness of the coat applied, avoidance of patterns, lines, runs, and the like. The significantly lower velocity avoids releasing of paint, or paint vapors, into the atmosphere which constitute a hazard to individuals in the vicinity due to inhaling, as experienced with conventional systems.

Furthermore, there is substantially less contamination of the paint during application and afterwards than with conventional systems due to several operative benefits of the method and apparatus of the present invention. Since, as previously noted, the compressor assembly employs an oiless rotary vane pump compressor, there is no oil which can contaminate the paint by being inadvertently mixed with the compressed air which is ultimately passed through the paint gun assembly. Since the velocity of the paint stream is substantially less than conventional systems, air currents are not created which may entrap dust, dirt, insects and other contaminants, as in conventional painting systems. Since the paint is applied more quickly and evenly than with conventional systems, the painting operation itself takes less time and therefore there is, for that reason alone, less opportunity for contaminants to become entrapped in, or on, the paint.

Since the paint is applied in a substantially contiguous stream, the paint is maintained substantially in its mixed form so that the paint can be applied in a manner permitting the operator to duplicate the appearance of the existing paint, in the case of a repainting operation, or otherwise to achieve the desired aesthetic effect. Thus, for example, where the paint applied is metallic, the mixture of the mica, or other metallic substances within the paint, can be maintained in such a manner that it can be used to reproduce the metallic appearance of the original existing paint. Thus, there is little, or no, risk that the metallic particles will, in effect, be buried within the paint and the resulting appearance be less metallic, or flat, as compared with the existing paint or the desired effect.

Additional benefits in the method and apparatus of the present invention include the fact that the operator is provided with a continuous fresh air supply from a single ultimate source with full control using the pressure regulator 291. Furthermore, the separate supplies of pressurized air to the paint gun assembly can be maintained at different air pressures under the individual control of the regulators 121 and 141. Thus, the operator can select the optimum combination of pressures for the particular type of paint, or other flowable substance, to be applied. In addition, the separate sources of compressed air come from a single ultimate source of substantial capacity. The apparatus is not susceptible to pulsing as with conventional systems due to the check valves 82, 110, 123 and 125. Thus, the stream of paint from the paint gun assembly is constant while being fully under the control of the operator by adjustment of the regulators. The water trap assembly 112 operates to remove moisture from the compressed air before it is supplied to the paint gun assembly thereby avoiding contamination from this potential source. Finally, the second conduit assembly 250 is housed for most of its length within the first section 201 of the first conduit thereby protecting it from inordinate wear and damage by foot, traffic, or sharp objects, while, at the same time, making the first and second conduits easier to control for most of their lengths due to having, in effect, a single conduit to control.

Therefore, the method and apparatus for dispensing a substance of the present invention are operable to ensure that the substance can be dispensed in precisely the manner desired to achieve precisely the result desired; are not subject to influences which cause a variation in the result achieved; are particularly well suited to the application of such substances as paints, lacquers, and other surface treating materials; permit different operators in different environments to achieve the same result, being able to replicate the result under virtually all conditions; are uniquely well suited to the repainting of surfaces affording as precisely the same result as in the paint being matched; and are otherwise entirely affective in achieving their operational objectives.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. A method for applying paint to a surface to be painted, the method comprising the steps of:

A. placing said paint, in a flowable condition, in the interior of a container adapted to be pressurized;

B. establishing a first passage through which said paint is to be passed and released onto said surface to be painted and communicating with the paint in the interior of said container through an opening;

C. establishing a second passage communicating with said interior of the container;

D. forcing gas under the pressure along said first passage to pressurize said paint within the interior of the container through the second passage and to apply a negative pressure to the paint in said container through said opening;

E. establishing a source of said pressurized gas within a reservoir using a rotary vane compressor;

F. individually releasing pressurized gas along first and second conduits individually communicating respectively with said first and second passages and wherein the second conduit is smaller in diameter than the first conduit, said first conduit is of more durable construction than the second conduit and the second conduit is extended substantially axially within the first conduit to protect the second conduit from wear during practice of the method; and G. individually regulating the pressures of said pressurized gases released along said first and second conduits so that the pressure of said pressurized gas passing along the second conduit is greater than the pressure of said pressurized gas passing along the first conduit whereby the paint flows from the interior of the container, along said first passage and is released onto said surface to be painted.

2. An apparatus for dispensing a flowable substance comprising a container having an interior adapted to receive said flowable substance; an assembly adapted to be operably connected to said container and having a first passage through which said flowable substance is to be dispensed and communicating with the interior of the container through an opening; means defining a second passage communicating with said interior of the container; and means for individually pressurizing said first and second passages to cause said flowable substance to be forced from the interior of the container through said opening and into said first passage to be dispensed, said pressurizing means including a rotary vane compressor connected in pressurized gas supplying relation to a reservoir adapted to store said pressurized gas, first and second conduits individually connected to said first and second passages in pressurized gas supplying relation and regulators individually operably connected to the first and second conduits for individually setting the pressures of said pressurized gases supplied to said first and second passages through the first and second conduits and wherein said first conduit is larger in diameter and of more durable construction than the second conduit and said second conduit is extended substantially axially through the first conduit for a portion of their respective lengths whereby the first conduit protects said second conduit from wear.

3. The apparatus of claim 2 wherein said first and second conduits communicate in pressurized gas receiving relation to said reservoir through a check valve operable substantially to prevent movement of the pressurized gas in said first and second passages through the apparatus in the direction of said reservoir whereby pulsing in the dispensing of said flowable substance is substantially avoided.

4. The apparatus of claim 2 wherein said pressurized gas is compressed air and including a third conduit connected in compressed air receiving relation to said first conduit and adapted operably to be connected to a face mask assembly to be worn by an operator of said apparatus in compressed air supplying relation whereby said operator can breathe air which is not contaminated by said flowable substance.

5. The apparatus of claim 4 wherein said third conduit is operably connected to a regulator operable to control the pressure of the compressed air supplied to the face mask assembly.

* * * * *

UNITED STATES PATENT AND TRADEMARK OFFICE

CERTIFICATE OF CORRECTION

PATENT NO. : 5,611,485

DATED : March 18, 1997

INVENTOR(S) : ROBERT G. DAVIS

It is certified that error appears in the above-identified patent and that said Letters Patent is hereby corrected as shown below:

Column 5, line 57, delete "vane" and substitute

---valve---.

Signed and Sealed this

Thirteenth Day of May, 1997

*Attest:*

Bruce Lehman

BRUCE LEHMAN

*Attesting Officer*

*Commissioner of Patents and Trademarks*